US010518939B2

(12) United States Patent
Estoque

(10) Patent No.: US 10,518,939 B2
(45) Date of Patent: Dec. 31, 2019

(54) DURABLE, CHILD-RESISTANT CONTAINER WITH SEAL THRUST BEARING

(71) Applicant: Daniel Anthony Estoque, Boulder, CO (US)

(72) Inventor: Daniel Anthony Estoque, Boulder, CO (US)

( * ) Notice: Subject to any disclaimer, the term of this patent is extended or adjusted under 35 U.S.C. 154(b) by 141 days.

(21) Appl. No.: 15/653,091

(22) Filed: Jul. 18, 2017

(65) Prior Publication Data

US 2018/0016063 A1 Jan. 18, 2018

Related U.S. Application Data

(60) Provisional application No. 62/363,756, filed on Jul. 18, 2016, provisional application No. 62/385,984, filed on Sep. 10, 2016, provisional application No. 62/421,892, filed on Nov. 14, 2016.

(51) Int. Cl.

| | |
|---|---|
| ***B65D 41/04*** | (2006.01) |
| ***B65D 50/00*** | (2006.01) |
| ***B65D 41/06*** | (2006.01) |
| ***B65D 81/38*** | (2006.01) |

(52) U.S. Cl.

CPC ..... *B65D 41/0442* (2013.01); *B65D 41/0471* (2013.01); *B65D 41/06* (2013.01); *B65D 41/065* (2013.01); *B65D 50/00* (2013.01); *B65D 81/3841* (2013.01)

(58) Field of Classification Search

CPC ..... B65D 41/0442; B65D 81/3841; B65D 41/0471; B65D 50/00; B65D 41/06; B65D 41/065

USPC ..... 220/293, 298; 215/222, 332

See application file for complete search history.

(56) References Cited

U.S. PATENT DOCUMENTS

| | | | | |
|---|---|---|---|---|
| 4,482,073 | A * | 11/1984 | Gagliardi | B65D 41/045 215/332 |
| 5,927,532 | A * | 7/1999 | Traub | B65D 41/06 215/222 |
| 6,149,022 | A * | 11/2000 | Akyildiz | A45D 34/045 215/222 |
| 7,703,617 | B1 * | 4/2010 | Branson | B65D 41/06 215/222 |
| 2006/0138139 | A1 * | 6/2006 | Keller | B60K 15/0406 220/295 |
| 2017/0001763 | A1 * | 1/2017 | Hu | B65D 41/045 |

* cited by examiner

*Primary Examiner* — James N Smalley

(74) *Attorney, Agent, or Firm* — Marsh Fischmann & Breyfogle LLP

(57) ABSTRACT

A high quality child resistant container comprising a durable metallic reservoir and durable plastic metal cap. The child resistant container comprises a durable and rugged reservoir and similarly durable locking cap. The cap is secured to the reservoir by a threaded, or bayonet-style connection. Once installed on the reservoir, the cap is prevented from being easily removed by a child, due to child resistant features integrated in the design of the cap and reservoir. Also, a method of reducing friction between the sealing surfaces of a sealed container. Specifically between the reservoir, cap and seal of a container, which allows easier closing of containers which require a simultaneous compression and twist motion to close.

13 Claims, 15 Drawing Sheets

DURABLE, CHILD-RESISTANT CONTAINER WITH SEAL THRUST BEARING

CROSS-REFERENCE TO RELATED APPLICATIONS

This patent application claims the benefit of the following: 1) U.S. Provisional Patent Application No. 62/363,756, filed on Jul. 18, 2016; 2) U.S. Provisional Patent Application No. 62/385,984, filed on Sep. 10, 2016; and 3) U.S. Provisional Patent Application No. 62/421,892, filed on Nov. 14, 2016. The entire disclosure of each application set forth in this Cross-Reference section is hereby incorporated by reference.

BACKGROUND

Child-resistant containers, such as for prescription medicines and other controlled substances, have typically been composed of plastic. Further, they have been low-cost, disposable designs, designed with little regard for functional longevity, durability or aesthetic appeal. As a result, the existing child lock containers are usually kept out of view in cabinets, which may be inconvenient for the user. The existing child-resistant containers also are not intended for outdoor or rugged use and thus cannot protect their contents from water or dust ingress, or rough handling during activities such as camping or boating. As a result, to keep medications dry during such activities, users have to transfer their medications from non-sealed child-safe containers to non-child-safe sealed containers, such as food storage containers or sealable plastic bags.

Also, some containers require a twisting motion to secure the cap, while at the same time needing a compression action to apply adequate pressure to an elastomeric seal. The elastomeric seal is a high-friction component which resists rotation resulting in high resistance to the required twisting motion, and unintended wear to components subjected to the resulting load. Further, the seal has not typically been of sufficient quality to completely prevent moisture or gases from traveling in or out of the container. Some have a barrier composed of two rigid plastic parts making contact, but they are not intended to be air or watertight.

Thin walled stainless steel and aluminum containers have become very popular as rugged, durable vessels to carry drinking water or other liquids. As these have grown in popularity, some of containers are now double-walled, to insulate the liquids inside from ambient temperatures.

It is against this background that the present invention has been developed. Improvements in these types of containers are desirable.

SUMMARY

Disclosed herein is a container assembly that includes: a container that is composed of a rigid and durable material, the container having a round opening formed therein, the container having engagement surfaces provided thereon adjacent to the opening, the container having a container axis passing orthogonally through the opening; a container lid that has engagement surfaces provided thereon for selective engagement with the engagement surfaces of the container, wherein the container lid is configured for rotational movement around the container axis to selectively engage or disengage the container lid to or from the container; and a seal positioned between the container lid and the container that hermetically seals the interior of the container from the ambient atmosphere when the container lid is engaged with the container. The torque required to rotate the container lid relative to the container to disengage the container lid is less than or equal to 5 ounce-inches.

The rigid and durable material may include steel. The rigid and durable material may include aluminum. The rigid and durable material may include ceramic material. The rigid and durable material may include carbon fiber material. The rigid and durable material may include a material selected from the group consisting of steel, aluminum, ceramic material, and carbon fiber material.

When the container lid is engaged with the container, the hermetic seal may withstand immersion in 1 meter of water for 30 minutes without passing water through the seal. The seal may be retained by the container lid and the container lid may include surfaces thereon that have a coefficient of friction at or below 0.2 which enable relative rotational movement between the surfaces so that the container lid can be rotated relative to the container without rotation of the seal relative to the container. The container lid may include a thrust bearing and a bushing that have surfaces that together have a coefficient of friction at or below 0.2. The seal may be retained by the container lid and the portion of the container that engages the seal may be a lip and wherein the seal and the lip together may have a coefficient of friction at or above 0.7 in order to resist relative rotational movement between the seal and the lip. The seal may be retained by the container lid and the container lid may include surfaces thereon that have a coefficient of friction at or below 0.2 which enable relative rotational movement between the surfaces so that the container lid can be rotated relative to the container without rotation of the seal relative to the container; and the portion of the container that engages the seal may be a lip and wherein the seal and the lip together may have a coefficient of friction at or above 0.7 in order to resist relative rotational movement between the seal and the lip. The seal may be retained by the container lid and the seal may have a bottom surface that faces towards the container lid and a face surface that faces in an opposite direction, away from the container lid and toward the container, and wherein the face surface of the seal may engage with the container. The face surface of the seal may engage with a lip formed on the container.

Disclosed herein is a method of substantially reducing friction in a locking container while closing, thus making the cap closure easier and reducing wear on components. Also disclosed is a high quality, reusable, rugged, durable, sealed container which has a child-resistant cap. The design of the container can be tailored to hold smaller volumes of dangerous or controlled substances rather than large volumes of liquid.

It is not necessarily the intent of the design to replace the low-cost disposable containers required when dispensing dangerous or controlled substances, but rather the design may be to a secondary container into which the said substances can be transferred, at home by the user, when a higher quality, more visually appealing, durable container is desired.

In one embodiment, the locking container and lid are made of machined metal or durable plastic with a locking mechanism having pin-based geometry. The cap is closed with a push and twist-to-lock motion, and is unlocked with a push and twist-to-unlock motion in the opposite direction.

In one embodiment, the enclosure is cylindrical in shape. In other embodiments, the enclosure can be a hollow tube with a curved cylindrical surface or square shape. The thick wall of the enclosure can be machined or otherwise fabricated to include decorative recesses or inlays.

The finished appearance of the enclosure can be a plain metallic finish, decoratively painted or decoratively anodized, brushed, silkscreened or otherwise finished to give a pleasing appearance, unlike typical child-proof locking containers In further embodiments, the locking feature can be a lug type or threaded lock.

In further embodiments, the lid can be sealed with an O-ring, gasket or other type of seal.

In further embodiments, the spring of the cap assembly can be replaced with a spring feature which is an integral part of the plunger, cap or lock ring.

In one embodiment, the spring element, which applies pressure to an elastomeric seal, has low-friction washers or bushings added which allows slippage between the elastomeric seal and the spring, both of which are inclined to have zero relative motion with their respective mating parts, the reservoir and the cap, which are being rotated with respect to each other. In another embodiment the thrust washers and bushing can be replaced by rolling bearings which provide even more friction reduction.

In another embodiment, the coil spring can be replaced by a different flexing element, or even removed altogether if the flexible nature of the seal is sufficient. The techniques taught herein can be applied to a conventional threaded closure, or bayonet style closure.

In another embodiment the locking container is made of thin walled metal, either single or double walled, and the cap is made of durable molded plastic with rubber seal.

In another embodiment the cap is closed with a threaded connection, with a locking tab that prevent the cap from being unscrewed unless the locking tab is depressed. The locking tab can be a simple cantilever type or a spring loaded pushbutton type latch.

In another embodiment the cap is closed with a threaded connection, but has an upper slip coupling that prevents the cap from being unscrewed unless pressure is exerted to prevent slippage between the upper slip coupling and the threaded cap.

DETAILED DESCRIPTION

Figure 1:
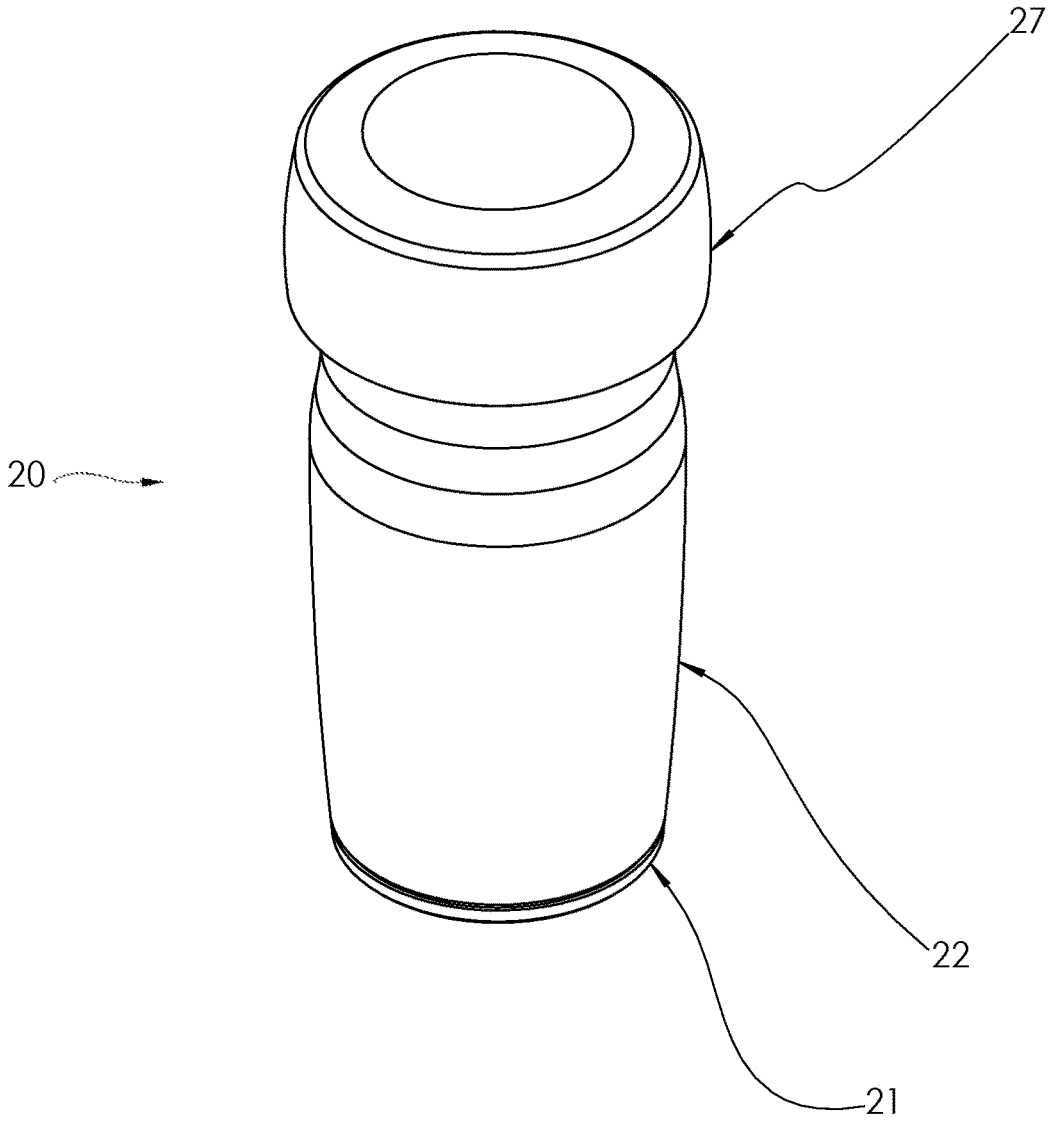
FIG. 1 shows a locking canister.

While the disclosure is susceptible to various modifications and alternative forms, specific embodiments thereof have been shown by way of example in the drawings and are herein described in detail. It should be understood, however, that it is not intended to limit the disclosure to the particular form disclosed, but rather, the disclosure is to cover all modifications, equivalents, and alternatives falling within the scope as defined by the claims.

The present disclosure generally relates to child resistant containers. More specifically, the disclosure relates to a child resistant container/dispenser having a long-lasting, durable construction, which can withstand many years of repeated use. The durable metal and plastic finish may have an external appearance which lends itself well to pleasing decorative options, so that the container may be more easily kept in open view, instead of being stored in a cabinet. Further, the containers may feature a low-friction compressed seal design.

Figure 2:
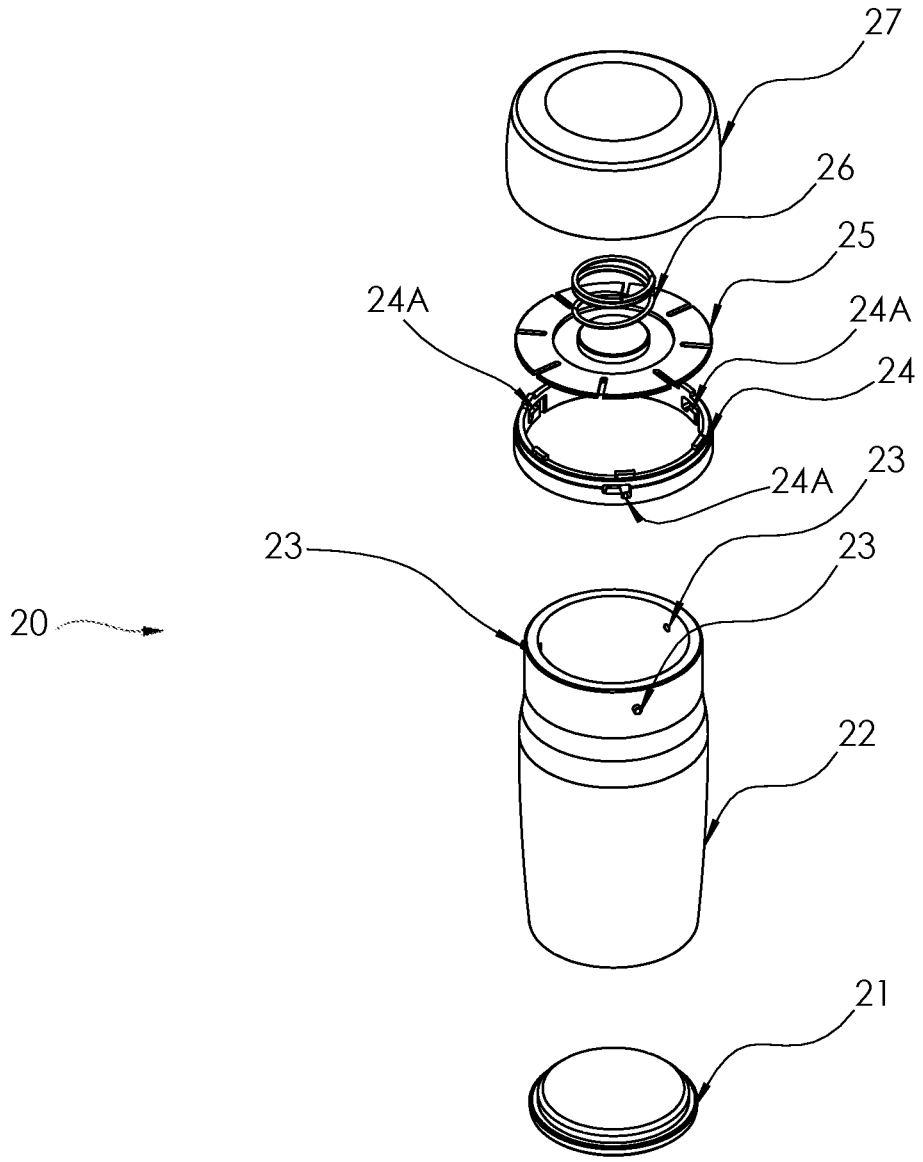
FIG. 2 shows an exploded view of the locking canister of FIG. 1.
Figure 3:
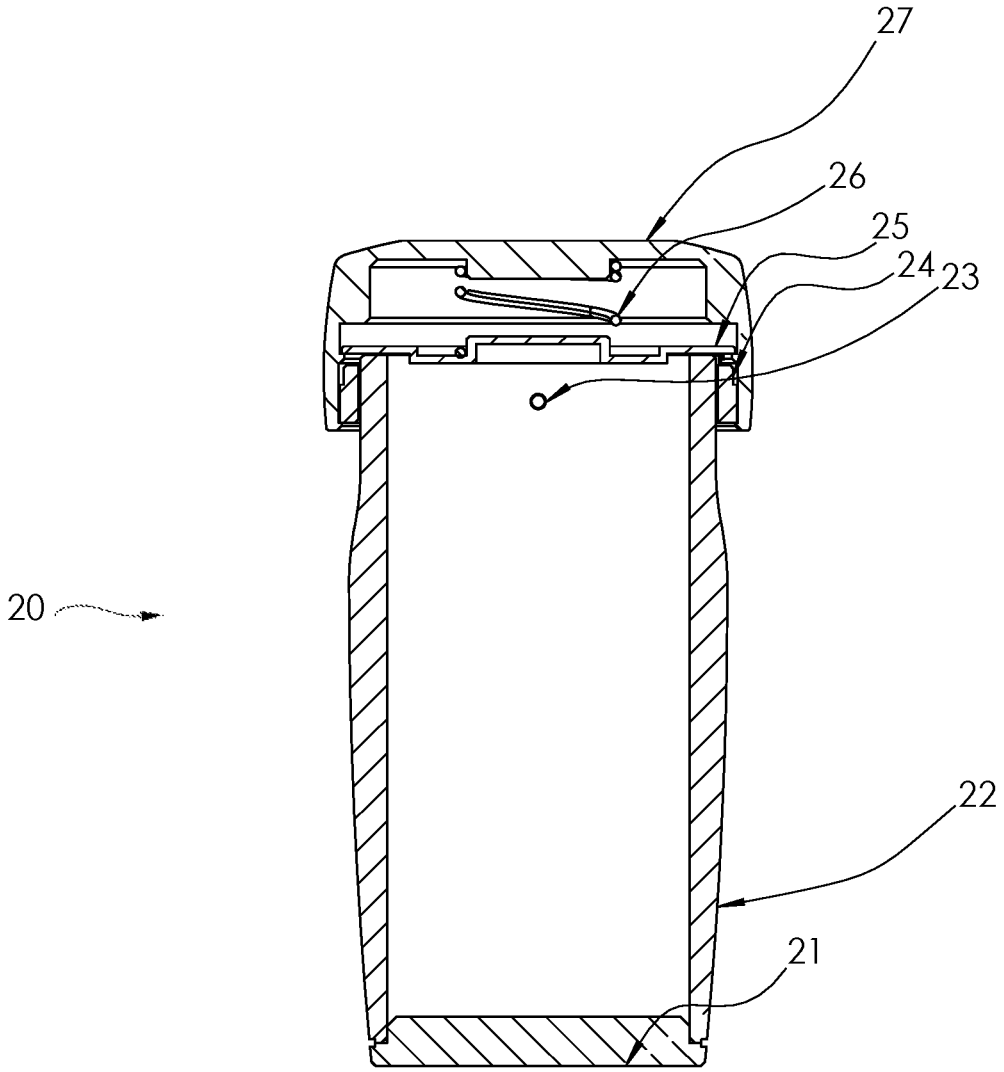
FIG. 3 shows a cross-sectional view of the locking canister of FIGS. 1 and 2.
Figure 4:
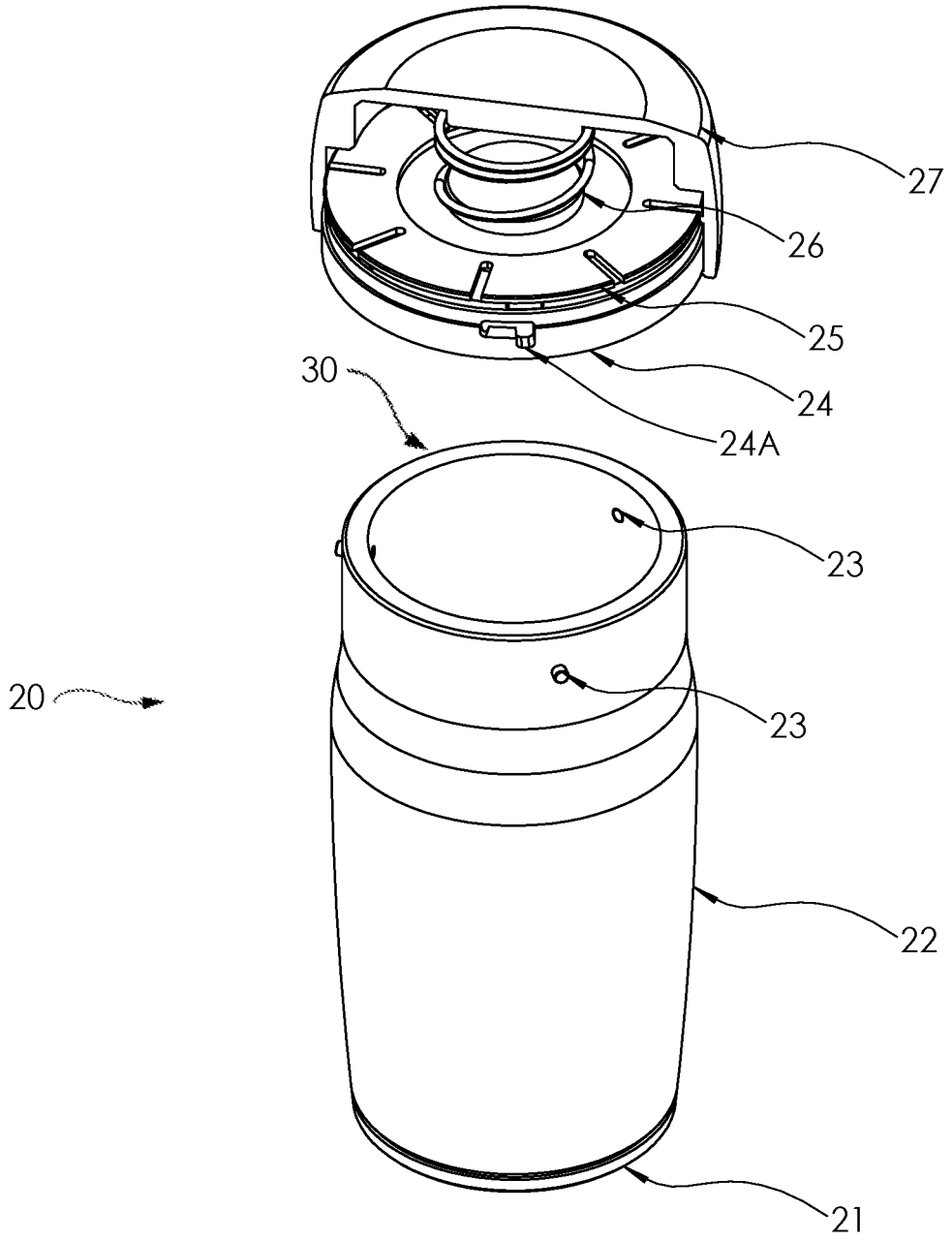
FIG. 4 shows the locking canister of FIGS. 1-3 with a portion of the lid cut away.

FIG. 1 shows a container assembly 20 with a bottom plug 21, a container body 22 in the form of an extruded or formed pipe defining a reservoir therein, and a lid or cap 27. FIG. 2 shows an exploded view of the container assembly 20 with the bottom plug 21, the container body 22, a plurality of locking pins 23 installed in the container body, a cap lock ring 24, a spring plunger 25, a spring 26 that urges the spring plunger 25 toward the container body 22, and the cap 27. FIG. 3 shows a cross-sectional view of the container assembly 20 with bottom plug 21, container body 22, locking pins 23, cap lock ring 24, spring plunger 25, spring 26, and cap 27. FIG. 4 shows the container assembly 20 with the locking pins 23 and the bottom plug 21 permanently installed into the container body 22 by press fit, threads, or other means to form a sealed bottom. The cap lock ring 24 has slots 24A formed therein which engage the locking pins 23 of the reservoir, in a "bayonet" style lock. When the cap 27 is installed, the spring 26 depresses the spring plunger 25, exerting force between the cap 27 and an upper lip 30 of the container body 22. The resulting force keeps the slots 24A in the lock ring 24 engaged with the lock pins 23, until the cap 27 is depressed and rotated.

Figure 5:
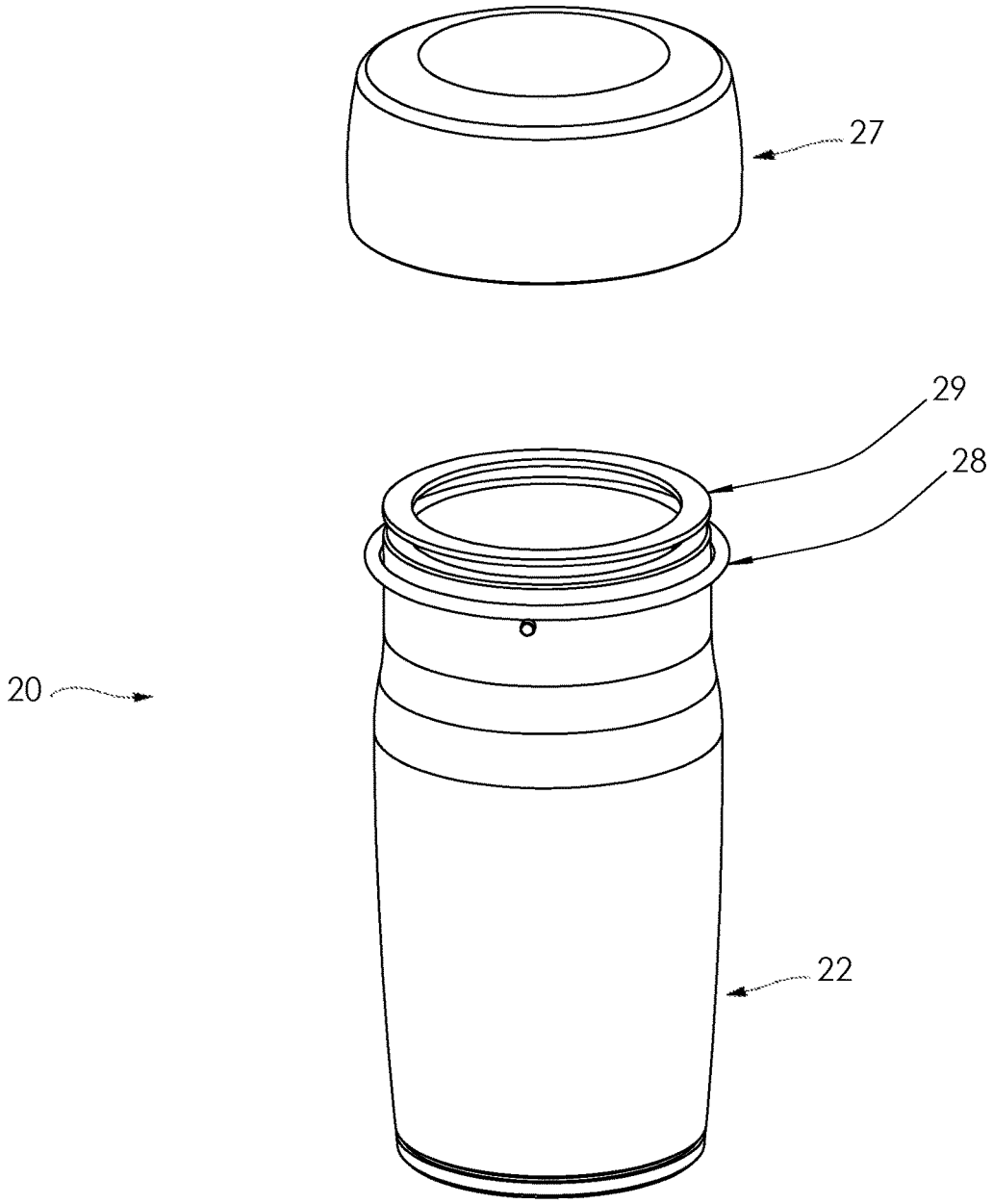
FIG. 5 shows the locking canister of FIGS. 1-4 with optional sealing components added thereto.

FIG. 5 shows an O-ring 28 and a gasket 29 as components that may optionally be provided to seal the cap 27 to the container body 22, if desired.

The embodiments herein are intended to minimize manufacturing costs of the reservoir, by allowing the reservoir to be produced by extrusion, but alternatively the reservoir container with locking features can be manufactured as a single piece, for example by machining or casting.

Figure 6:
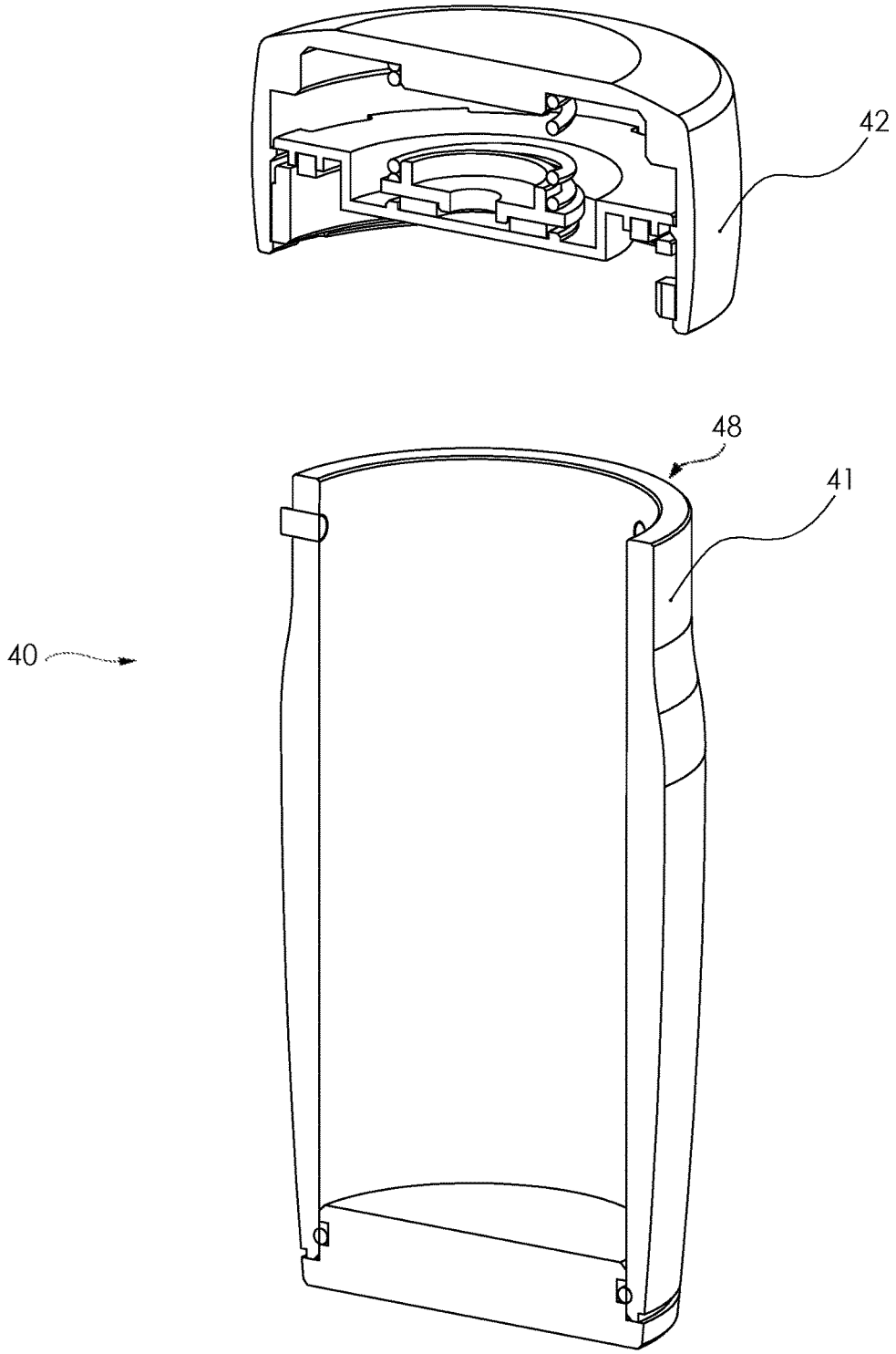
FIG. 6 shows another embodiment of a locking canister, with portions cut away, showing optional low-friction thrust bearing components.
Figure 7:
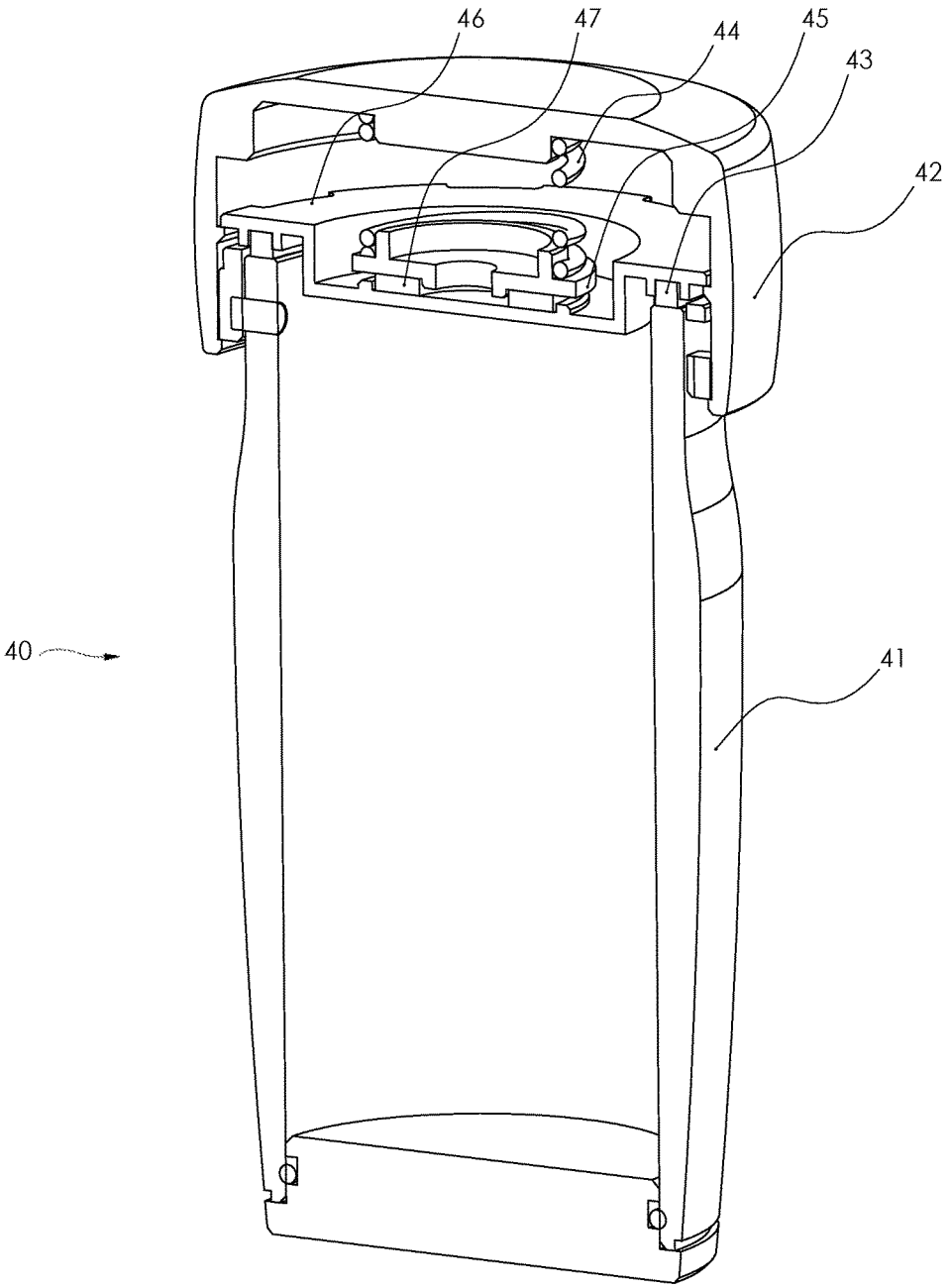
FIG. 7 shows another view of the locking canister of FIG. 6.

FIG. 6 shows another embodiment of a container assembly 40 with a container body 41 and a cap assembly 42. FIG. 7 shows the cap assembly 42 secured to the container body 41. An elastomeric seal 43 retained by a spring plunger 46 of the cap assembly 42 makes contact with an upper lip 48 of the container body 41. Compressive pressure necessary to make a sufficient seal is provided by a spring 44 urging the spring plunger 46 toward the lip 48. Low-friction elements such as a thrust washer 47 and a bushing 45 are added between the spring 44 and the spring plunger 46. The spring plunger 46 may also be composed of low-friction materials.

Figure 8:
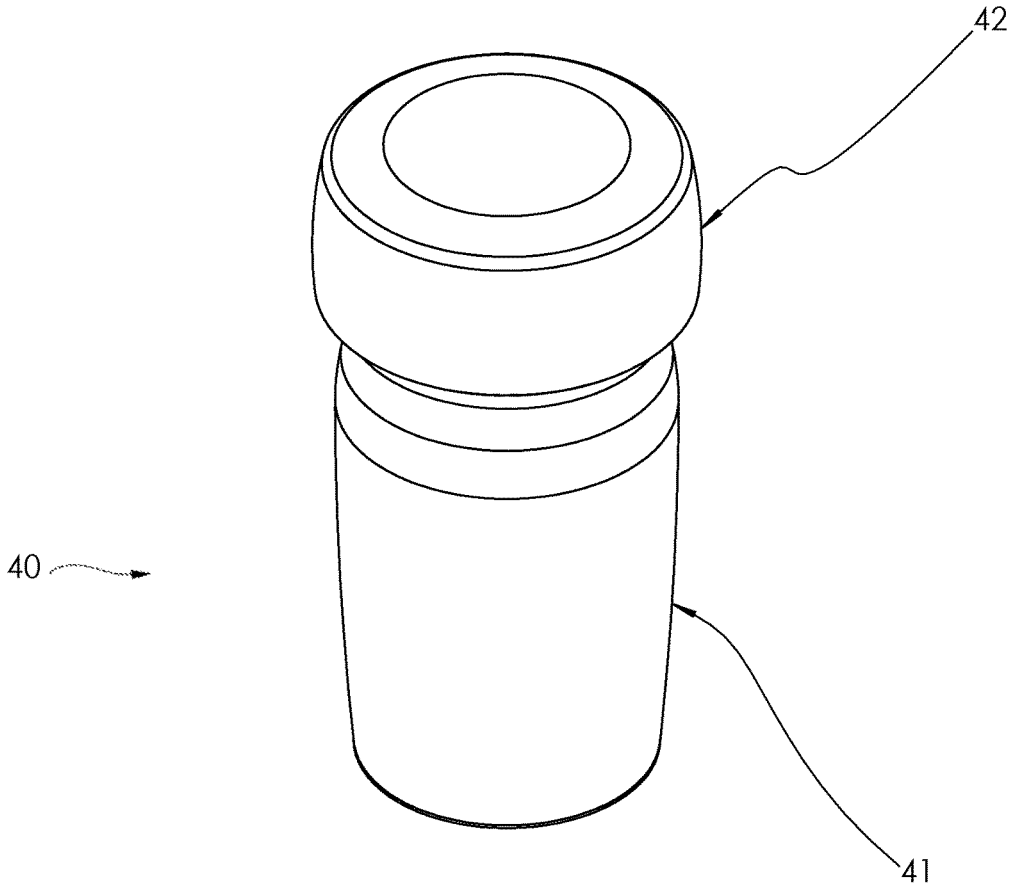
FIG. 8 shows another view of the locking canister of FIGS. 6 and 7.

FIG. 8 shows the container assembly 40 with the cap assembly 47 attached to the container body 42. The elastomeric seal 43 could be made of a soft rubber compound, such as Buna-N, Viton, or Silicone with hardness of 70 Durometer Shore A. The thrust washer 47, and bushing 45 could be made of low-friction materials such as Polytetrafluoroethylene (PTFE) or Polyoxymethylene (POM).

Compression is applied to the spring 44 by the cap assembly 42 during closure by the user. During the compression and rotation of the cap assembly 42 relative to the container body 41, this rotational motion is resisted by high friction between the seal 43 and reservoir lip 48. High friction resisting rotation also exists between the cap assembly 42 and the spring 44. In effect, the cap assembly 42 is coupled to the seal 43 in a rigid arrangement which resists the necessary rotation during closure. This would normally make closing the container difficult and cause wear between the components by forcing relative motion between components not designed for this function.

To reduce the resistance and wear during closure, low-friction elements are added in the chain of components between the cap assembly 42 and the seal 43, which results in easy, low-wear relative motion between the outer cap and the elastomeric seal 43. It should be understood that any of the container lids disclosed herein could be outfitted with these low-friction elements.

Figure 9:
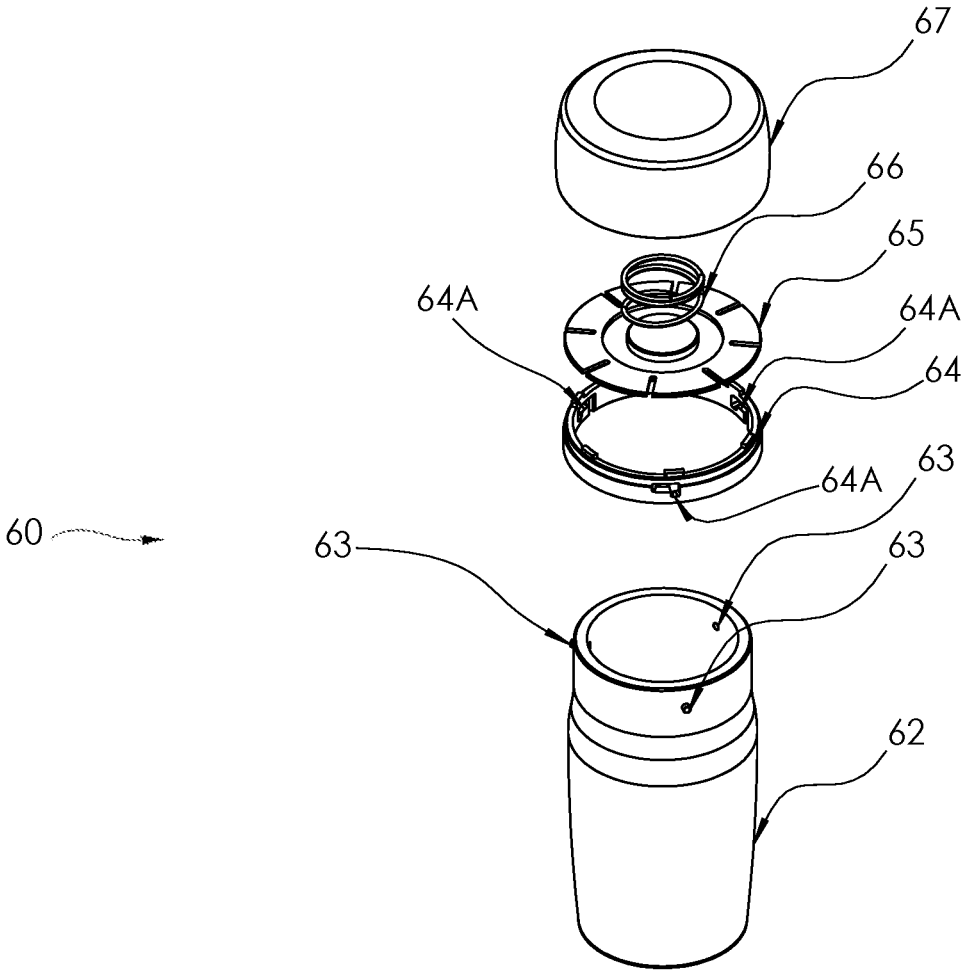
FIG. 9 shows an exploded view of another embodiment of a locking canister.
Figure 10:
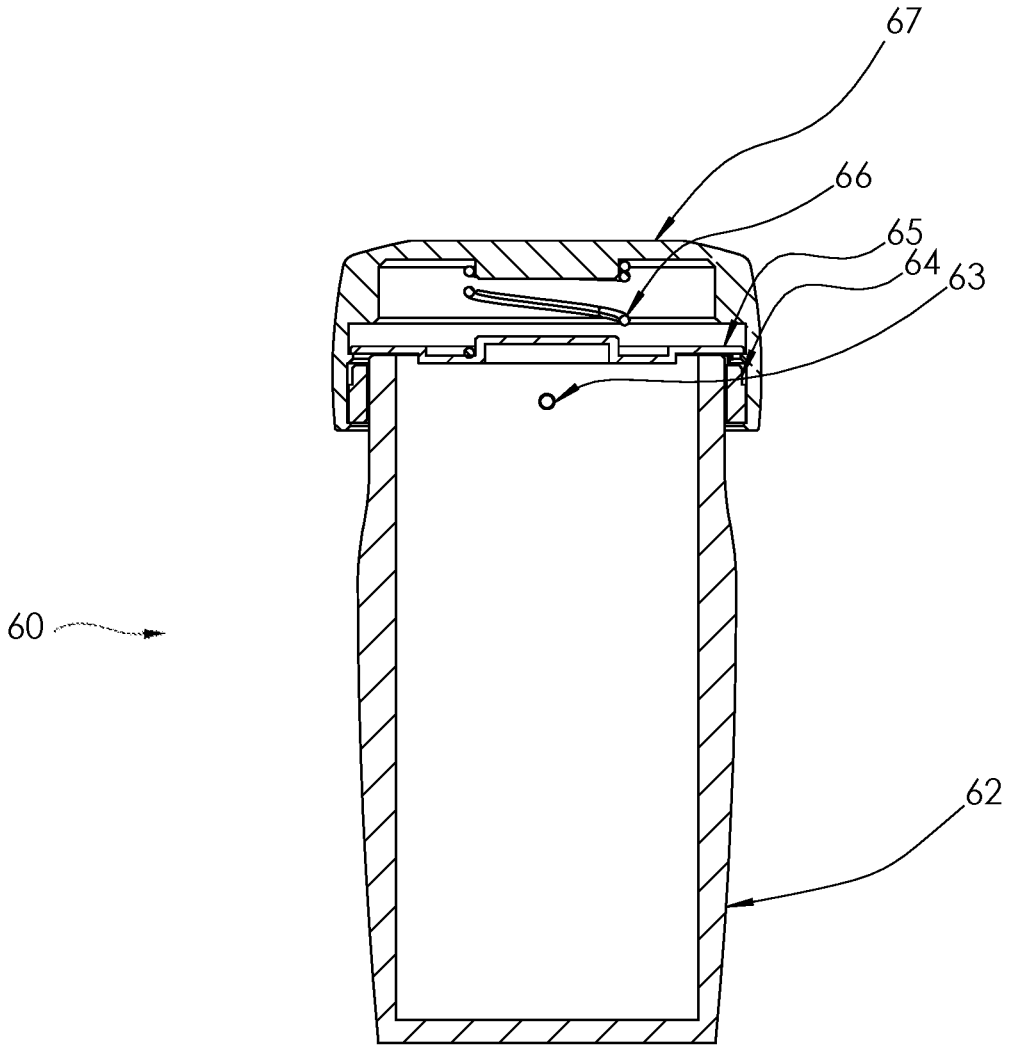
FIG. 10 shows a cross-sectional view of the locking canister of FIG. 9.
Figure 11:
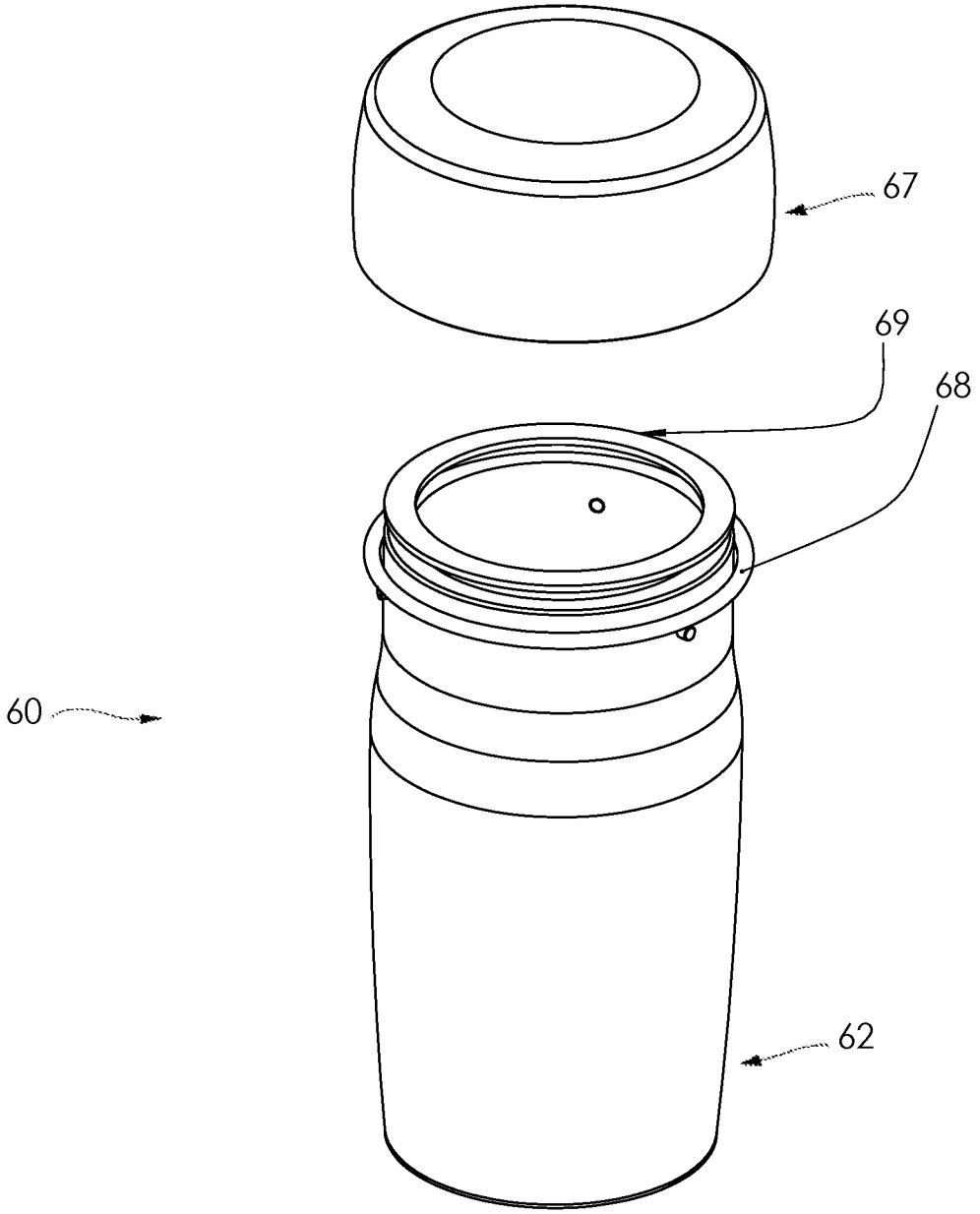
FIG. 11 shows another view of the locking canister of FIGS. 9 and 10.

FIG. 9 shows an exploded view of another embodiment of a container assembly 60, including a bayonet-style container body 62, three locking pins 63, a cap lock ring 64, a spring plunger 65, a spring 66, and a cap 67. FIG. 10 shows a cross sectional view of the bayonet-style container body 62, the locking pins 63, the cap lock ring 64, the spring plunger 65, the spring 66, and the cap 67. FIG. 11 shows an o-ring 68 and a gasket 69 as optional components to seal the cap assembly to the container body 62 if desired.

Figure 12:
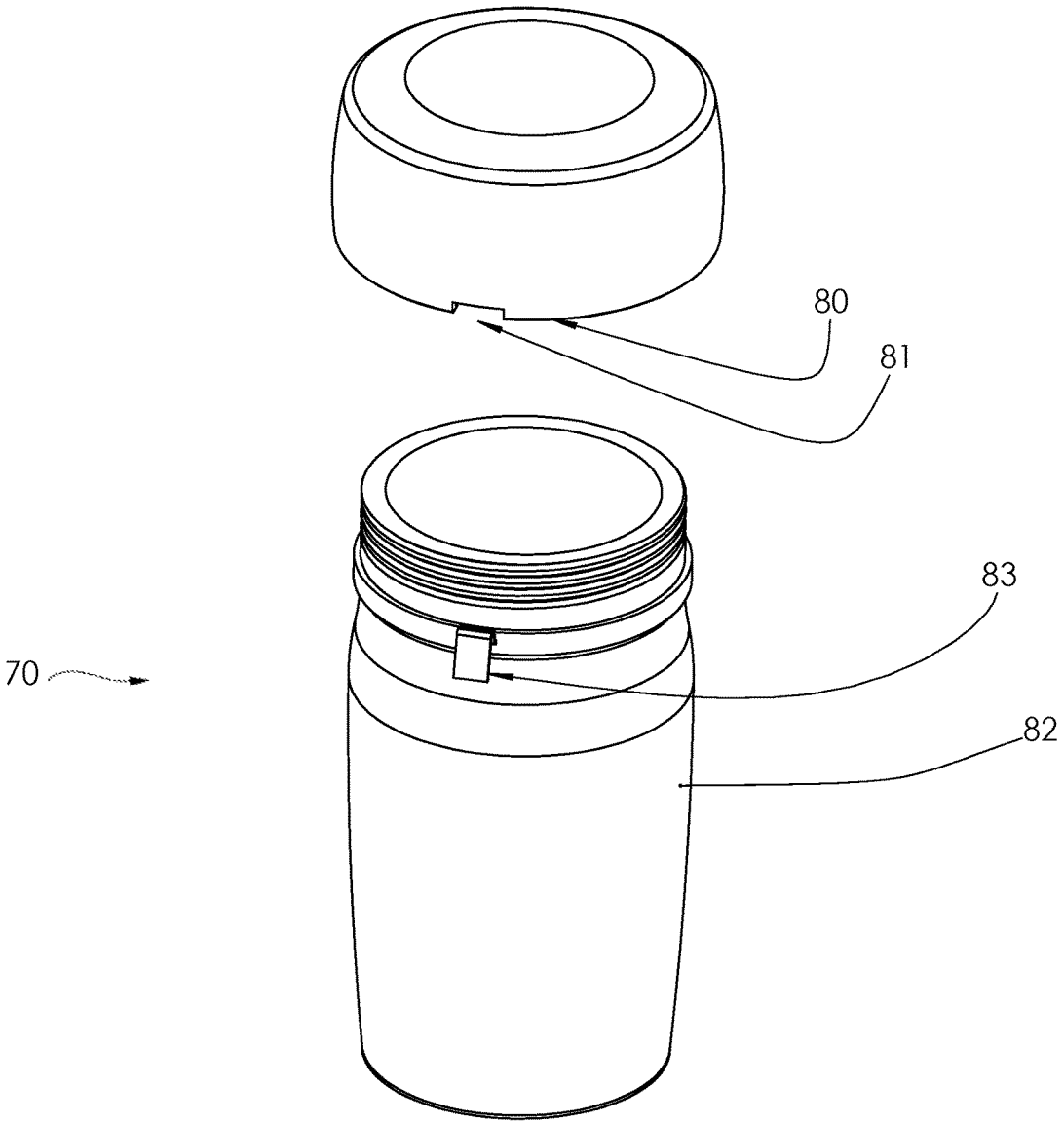
FIG. 12 shows another embodiment of a locking canister.
Figure 13:
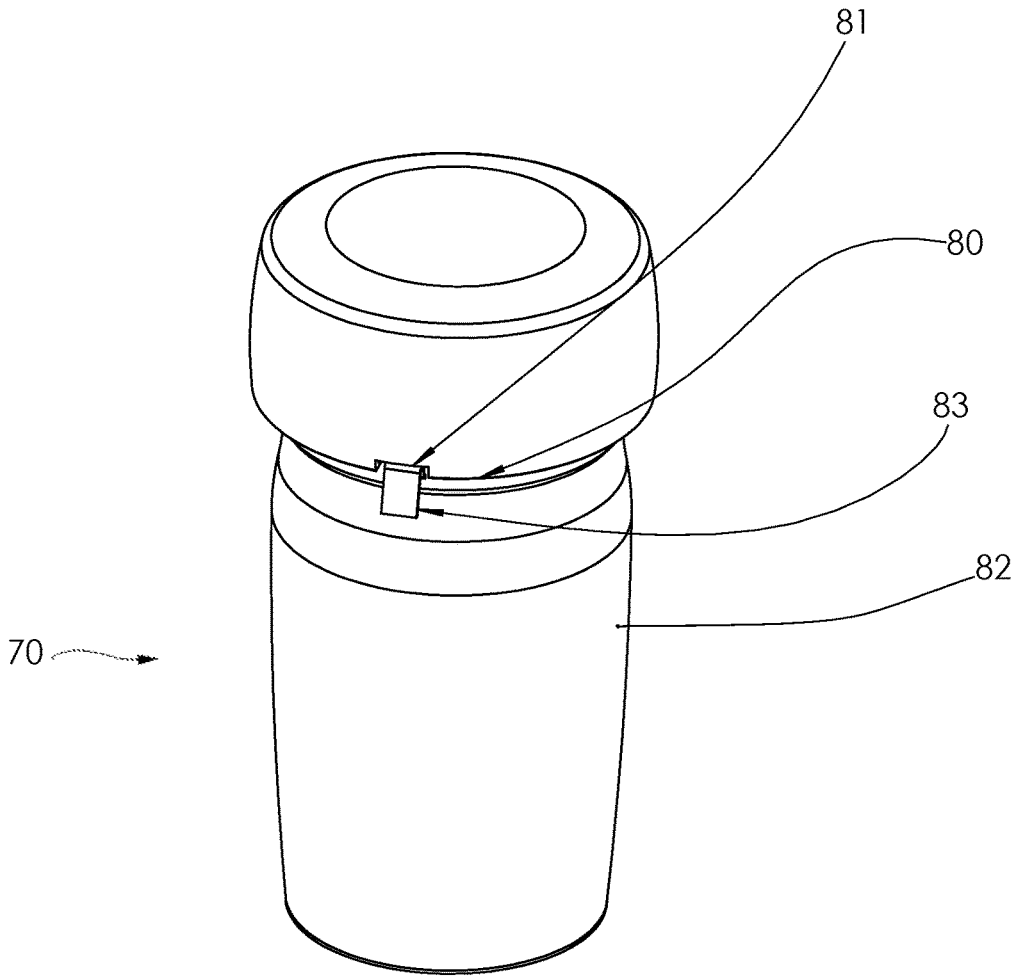
FIG. 13 shows another view of the locking canister of FIG. 12.
Figure 14:
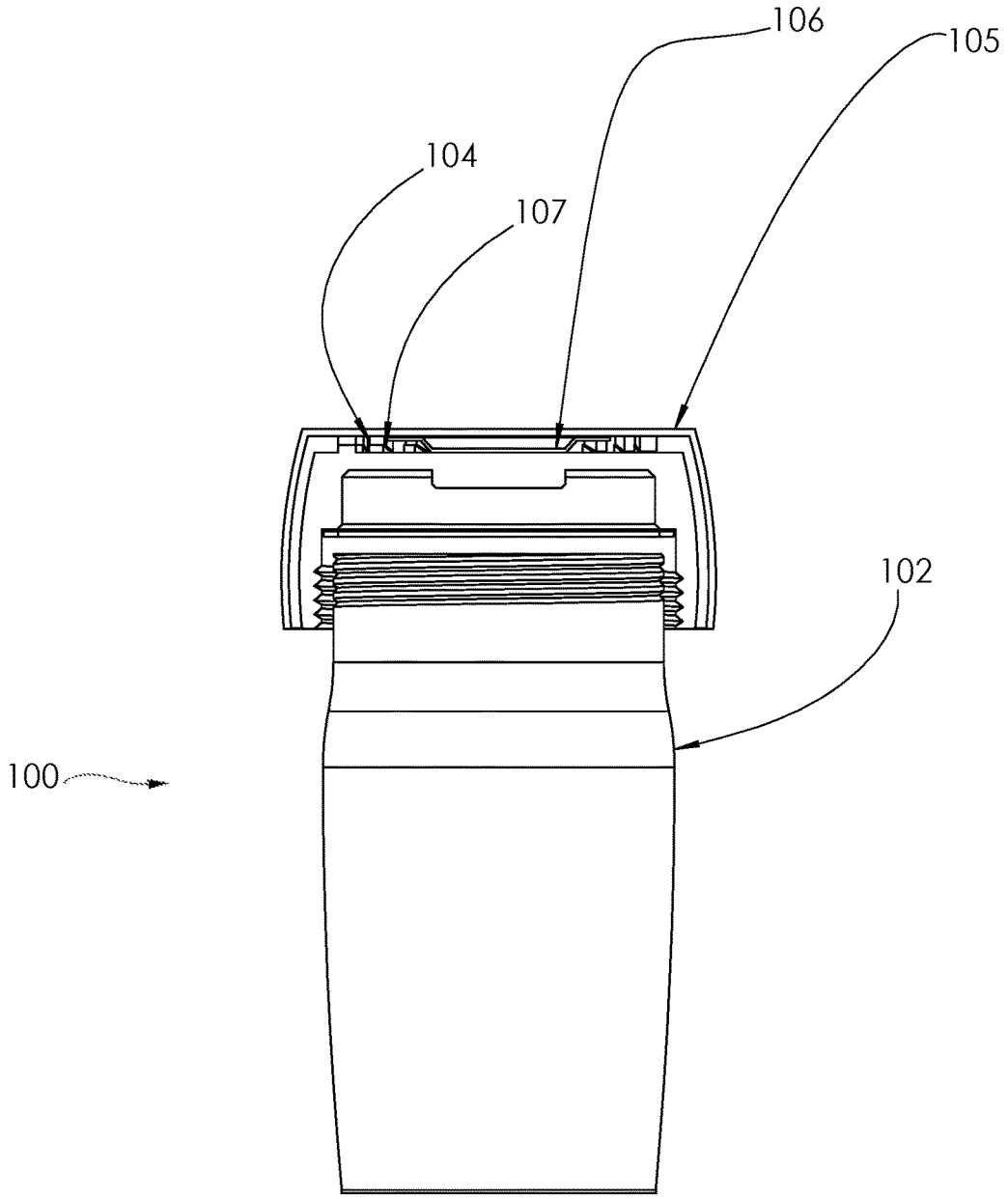
FIG. 14 shows another embodiment of a locking canister.
Figure 15:
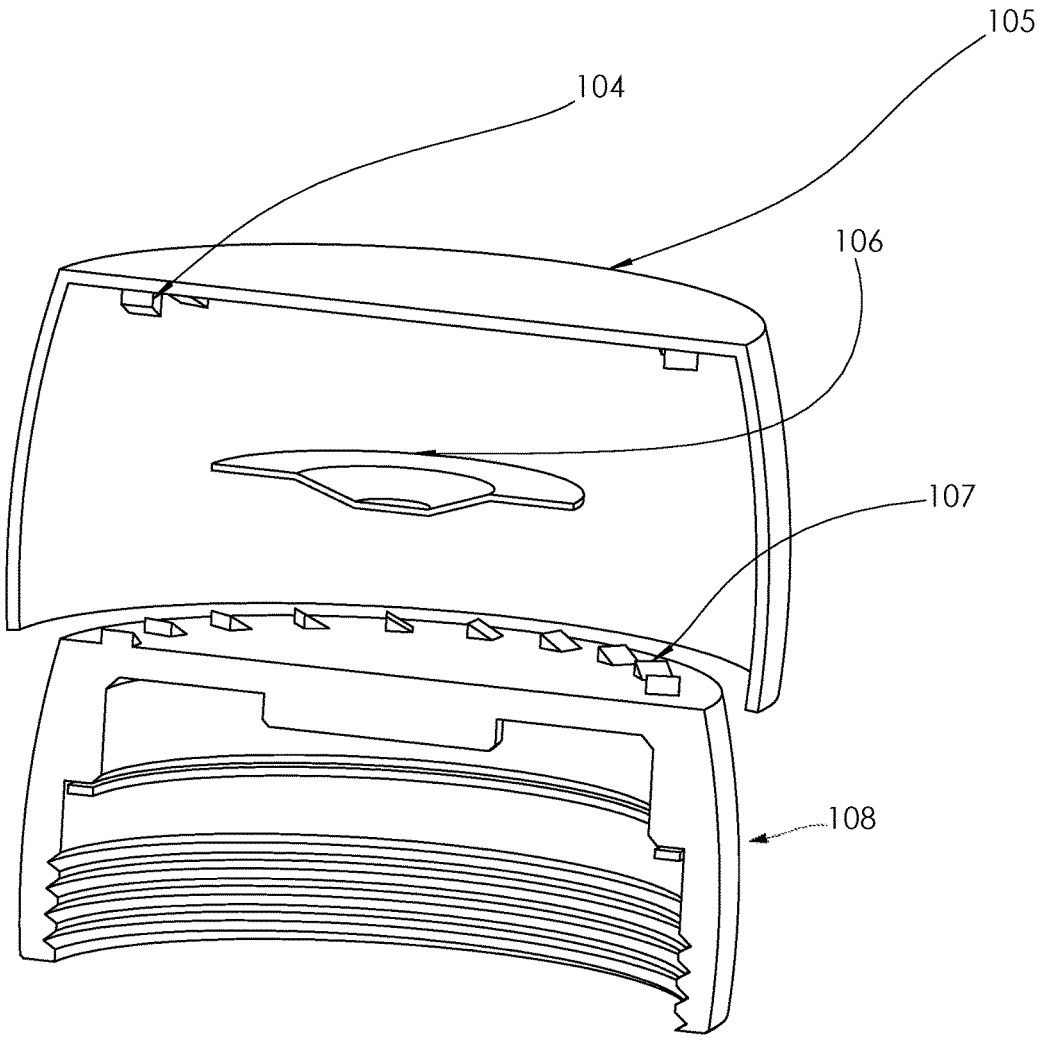
FIG. 15 shows an enlarged portion of the locking canister of FIG. 14.

FIG. 12 shows 70 the threaded-style container body 82 and the threaded-style cap 80, in an open position. A lock tab 83 and a lock notch 81 prevent the cap 80 from being unscrewed unless the lock tab 83 is depressed. FIG. 13 shows the threaded-style container body 82 and threaded-style cap 80, in a closed position. The lock tab 83 and the lock notch 81 are shown engaged. The lock tab 83 can be attached to a ring to make assembly to the container body 82 easier and fixed from rotating with respect thereto. In another embodiment, the lock ring is attached to the cap and the locking notch is attached to the reservoir FIG. 14 shows another embodiments of a container assembly 100, with a threaded container body 102 and a threaded, slip-coupling-style cap outer 105, shown in a closed position. FIG. 15 shows the threaded cap with the slip coupling (104, 106, and 107) in detail. Inner cap teeth 107 that engage outer cap teeth 104, with spring 106 that keeps teeth disengaged until downward pressure is applied to the outer cap 105. The inner and outer caps 105 and 108, respectively, are secured together by snap fit or other means, allowing relative rotation between the two. The shape of the teeth 104 and 107 allow the upper and lower caps 108 and 105 to engage each other when being turned clockwise, but to slip with respect to each other when being turned counter-clockwise.

An alternative embodiment is to have the cap and lock ring features manufactured as a single piece, for example by machining or casting.

In general, this disclosure describes child-resistant locking containers intended to store medications. These containers are intended to comply with the U.S. Consumer Products Safety Commission (CPSC) rules requiring child resistant (CR) packaging for household products. Unlike, existing low-cost, disposable child resistant containers, these containers have the advantage of being long-lasting and reusable due to robust materials and construction. These containers are intended to withstand physical abuse, extreme environmental exposure, high temperature washing and various types of sterilizing, and rough handling. Due to their robust, engineered design, unlike existing designs, these containers have the advantage of being able to withstand outdoor, harsh commercial, and military use. In addition, the design, materials and construction used in the present design allow the containers to be more readily given cosmetic and aesthetic treatments not possible with existing low-cost plastic molded designs.

An alternative embodiment is to have the cap and lock ring features manufactured as a single piece, for example by machining or casting.

Labeling instructions to install and remove the cap can be printed or machined on the device surfaces. In addition, a label can be added to the container to identify various contents.

Due to advances in manufacturing thin walled liquid bottles, the containers described herein should be able to be mass produced at low cost.

Certain terminology herein is provided with more specificity with the following specifications, merely by way of example.

For the low friction hermetic seal—the torque required to rotate the cap during closure may be a maximum of 5 oz-in.

For the quality of the hermetic seal—the cap seal may withstand immersion in 1 meter of water for 30 minutes per MIL-STD-810G 512.5 (Immersion).

For shock (drop)—the integrity of the seal and the locking cap shall withstand shock per MIL-STD-810G, Method 516.6, Procedure IV (Shock, Transit Drop).

For vibration—the integrity of the seal and the locking cap shall withstand vibration per MIL-STD-810G, Method 516.6, Procedure I, Category 4 (Vibration, Common Carrier, US Highway Truck Vibration Exposure).

For high temperature—the integrity of the seal and the locking cap shall withstand high temperature conditions per MIL-STD-810G, Method 501.5, Procedure II (Operational), 55° C. for 2 hours.

For low temperature—the integrity of the seal and the locking cap shall withstand low temperature conditions per MIL-STD-810G, Method 502.5, Procedure II (Operational), −10° C. for 2 hours.

For crush-resistance—the container can withstand at least 200 lbs. minimum of compressive force without damage to the seal integrity or the child-safe function.

For extended use—the container can withstand a minimum of 10,000 opening/closing cycles without damage to the seal integrity or the child-safe function.

The techniques taught and claimed herein are believed to be novel and non-obvious in part because of the combination of the ability to withstand compressive force, temperature extremes, vibration, exposure to chemicals, and the ability to seal liquids and gases from passing in or out of the container. For more specifics, please consider the following sections.

Improved Reliability Over a Range of Operating Conditions

A simple change in materials to existing, low-cost plastic designs would not result in a reliable, long-term rugged, sealed design, because the seal design on existing products is intended for low-cost, disposable products, and no consideration is given in the design to long-term repeated use under a wide range of severe environmental conditions.

Consequently, in existing designs, the friction and wear on the seal experienced during repeated opening and closing will quickly render the seal completely ineffective against water and air ingress.

With the designs disclosed herein, the longevity of the seal during repeated opening and closing is improved substantially by completely preventing any relative rotation between the seal and adjacent components, which eliminates seal wear. This is accomplished by adding low friction thrust bearing features between the seal and the rotating cap. The sealing surfaces of the parts which directly contact the soft rubber seal (i.e., the tube lip and the seal plunger) are designed to have a high coefficient of friction of 0.60 with the soft rubber seal. This acts to prevent relative motion between the seal and its adjacent parts during rotation.

Conversely, the parts between the rotating cap and seal are design to have a low coefficient of friction of 0.20. This acts to encourage relative motion between components of the thrust bearing during rotation. Axial pressure is applied to the cap during opening and closing in order to engage and disengage the child-safe features of the cap and tube. With the tube held stationary, this axial pressure creates a watertight interface between the seal and surfaces adjacent thereto, the spring plunger and the tube lip. In addition to sealing, the axial pressure creates high static friction between the seal and surfaces adjacent thereto, the spring plunger and the tube lip. Since the components between the rotating cap the spring plunger and relatively low static friction, the result is that during opening and closing of the child safe cap, the soft rubber seal is isolated from the rotational motion being applied to the cap, which prevents wear of the seal and allows it to operate reliably, without needing replacement over several thousand cycles.

Another improvement over the existing, low-cost plastic designs, is that the plastic seal in existing devices also functions doubly as the spring which maintains engagement of the child-safe locking features between the cap and tube. Having the locking spring in low-cost designs made from plastic is a good, low-cost solution. But the intended function of the plastic spring would change dramatically under changing temperature conditions. The result is that, under high temperature conditions, the spring rate of the plastic springs on existing designs would decrease dramatically, and substantially alter the child-safe characteristics of the design. Also, under low temperature conditions, the plastic spring would become stiffer, brittle and prone to breakage.

Converting the dual purpose seal/spring of existing designs from plastic to metal would improve the limited temperature range of the spring, but in converting the design from plastic to metal, the compliant characteristic of the seal will be lost.

With the designs disclosed herein, the child-safe function and seal function operate as intended over a much wider range of temperature conditions because the dedicated metal spring maintains its required characteristics much better than a plastic spring, and the separate seal can be made of a soft material which is better for sealing. The dual purpose spring/seal of existing designs use a rigid plastic which can function as both a spring and seal, but is not ideal for either function, and less effective than a separate metal spring with soft rubber seal.

Automatic Ejection

The seal is also designed to make contact with the tube in an axial direction, or face seal, as opposed to making contact in a squeezing or radial direction. By orienting the seal pressure in the axial direction, this ensures that the axially-acting spring will automatically disengage the seal from the tube during opening. Conversely, with a radially acting seal, once the locking features between the cap and tube are disengaged during opening, the seal wants to continue to radially grip the sealing surface of the tube, so that the cap resists disengagement via friction, form the tube. This would cause the user to intentionally have to pull the cap free from the tube during cap opening, or necessitate the use of a very strong spring to accomplish disengagement.

Basically, the existing plastic designs are designed to be low-cost and disposable, and as a result can maintain their sealing and child-safe functions only under low-stress, room-temperature conditions, and only for a limited number of opening/closing cycles.

The design of the containers is intended to maintain watertight sealing and child-safe function for a long service life (>10,000 cycles) and over a wide range of high stress, extreme environmental conditions. In order to achieve these requirements, the design uses a dedicated metal spring and an axially-acting soft rubber face seal, instead of the low cost plastic spring and rigid seals used in existing devices. To achieve a long service life of the soft, rubber seal, the design employs a low-friction thrust bearing to prevent relative rotation and wear of the rubber seal during opening and closing.

Also, a ruggedized, sealed design cannot be achieved by simply converting existing low-cost designs to a more rugged and durable material, like metal. If an attempt were made to convert these existing low-cost products to more durable products by simply changing the materials (to more durable ones like metal), they would not function properly, even under nominal ambient conditions, and certainly not under a wide range of environmental conditions.

While the foregoing has illustrated and described several embodiments in detail in the drawings and foregoing description, such illustration and description is to be considered as exemplary and not restrictive in character. For example, certain embodiments described hereinabove may be combinable with other described embodiments and/or arranged in other ways (e.g., process elements may be performed in other sequences). Accordingly, it should be understood that only the preferred embodiment and variants thereof have been shown and described and that all changes and modifications that come within the spirit of the disclosure are desired to be protected.

I claim:

1. A container assembly, comprising:

a container that is composed of a rigid and durable material, the container having a round opening formed therein, the container having engagement surfaces provided thereon adjacent to the opening, the container having a container axis passing orthogonally through the opening;

a container lid that has engagement surfaces provided thereon for selective engagement with the engagement surfaces of the container, wherein the container lid is configured for rotational movement around the container axis to selectively engage or disengage the container lid to or from the container; and a seal positioned between the container lid and the container that hermetically seals the interior of the container from the ambient atmosphere when the container lid is engaged with the container;

wherein the torque required to rotate the container lid relative to the container to disengage the container lid is less than or equal to 5 ounce-inches;

wherein the seal is retained by the container lid and the container lid includes first and second surfaces that engage one another and that have a coefficient of friction at or below 0.2 which enables relative rotational movement between the first and second surfaces so that the container lid can be rotated relative to the container without rotation of the seal relative to the container;

wherein the container lid includes a thrust bearing and a bushing that have surfaces that together have a coefficient of friction at or below 0.2, wherein the thrust bearing comprises the first surface and the bushing comprises the second surface.

2. A container assembly as defined in claim 1, wherein the rigid and durable material includes steel.

3. A container assembly as defined in claim 1, wherein the rigid and durable material includes aluminum.

4. A container assembly as defined in claim 1, wherein the rigid and durable material includes ceramic material.

5. A container assembly as defined in claim 1, wherein the rigid and durable material includes carbon fiber material.

6. A container assembly as defined in claim 1, wherein the rigid and durable material includes a material selected from the group consisting of steel, aluminum, ceramic material, and carbon fiber material.

7. A container assembly as defined in claim 1, wherein when the container lid is engaged with the container, the hermetic seal withstands immersion in 1 meter of water for 30 minutes without passing water through the seal.

8. A container assembly as defined in claim 1, wherein the seal is retained by the container lid and the portion of the container that engages the seal is a lip and wherein the seal and the lip together have a coefficient of friction at or above 0.7 in order to resist relative rotational movement between the seal and the lip.

9. A container assembly as defined in claim 1, wherein the seal is retained by the container lid and the container lid includes first and second surfaces that engage one another and that have a coefficient of friction at or below 0.2 which enables relative rotational movement between the first and second surfaces so that the container lid can be rotated relative to the container without rotation of the seal relative to the container; and wherein the portion of the container that engages the seal is a lip and wherein the seal and the lip together have a coefficient of friction at or above 0.7 in order to resist relative rotational movement between the seal and the lip.

10. A container assembly as defined in claim 1, wherein the seal is retained by the container lid and the seal has a bottom surface that faces towards the container lid and a face surface that faces in an opposite direction, away from the container lid and toward the container, and wherein the face surface of the seal engages with the container.

11. A container assembly as defined in claim 10, wherein the face surface of the seal engages with a lip formed on the container.

12. A container assembly as defined in claim 1, wherein the container lid further comprises:

a spring plunger that engages the seal;

an outer lid body; and a spring disposed between the outer lid body and the bushing, wherein the bushing engages the thrust bearing, and wherein the thrust bearing is disposed between the bushing and the spring plunger.

13. A container assembly as defined in claim 12, wherein the outer lid body is able to rotate relative to the container by relative movement between the bushing and thrust bearing and without requiring relative movement between the seal and the container.

* * * * *